US006012307A

United States Patent [19]

Malchow

[11] Patent Number: 6,012,307

[45] Date of Patent: Jan. 11, 2000

[54] DRY-CLEANING MACHINE WITH CONTROLLED AGITATION

[75] Inventor: Gregory L. Malchow, Oshkosh, Wis.

[73] Assignee: Ratheon Commercial Laundry LLC, Ripon, Wis.

[21] Appl. No.: 08/998,399

[22] Filed: Dec. 24, 1997

[51] Int. Cl.[7] ..... B08B 3/04

[52] U.S. Cl. ..... 68/183; 68/207; 134/102.2

[58] Field of Search ..... 68/12.16, 183, 68/207; 134/102.2, 102.1, 157, 153

[56] References Cited

U.S. PATENT DOCUMENTS

| | | | |
|---|---|---|---|
| 2,201,685 | 5/1940 | Lorenzen . | |
| 4,950,969 | 8/1990 | Getz | 68/12.16 |
| 5,013,366 | 5/1991 | Jackson et al. . | |
| 5,316,591 | 5/1994 | Chao et al. . | |
| 5,339,844 | 8/1994 | Stanford, Jr. et al. . | |
| 5,370,740 | 12/1994 | Chao et al. . | |
| 5,456,759 | 10/1995 | Stanford, Jr. et al. . | |
| 5,467,492 | 11/1995 | Chao et al. . | |
| 5,482,211 | 1/1996 | Chao et al. . | |
| 5,651,276 | 7/1997 | Purer et al. . | |
| 5,669,251 | 9/1997 | Townsend et al. . | |
| 5,718,130 | 2/1998 | Kim . | |

FOREIGN PATENT DOCUMENTS

| | | |
|---|---|---|
| 877733 | 12/1942 | France . |
| 424214 | 7/1923 | Germany . |
| 220355 | 3/1985 | Germany . |

*Primary Examiner*—Frankie L. Stinson
*Attorney, Agent, or Firm*—Leydig, Voit & Mayer, Ltd.

[57] ABSTRACT

A dry-cleaning system operable for selectively controlling agitation of items during cleaning, rinsing, and draining cycles. The dry-cleaning system includes a pressure vessel for containing a liquid gas dry-cleaning solvent and a rotary basket disposed within the vessel for containing items to be cleaned. Controlled agitation is achieved by the combination of (1) driving the basket by a directional, variable speed motor and (2) a simultaneously selectively operable gas jet system having a plurality of nozzles rotatable with the basket for directing pressurized jet streams into the liquid wash bath.

16 Claims, 4 Drawing Sheets

DRY-CLEANING MACHINE WITH CONTROLLED AGITATION

FIELD OF THE INVENTION

The present invention relates to dry-cleaning systems and, more particularly, to a dry-cleaning system having a cleaning vessel in which agitation of items contained therein may be selectively controlled for enhanced and faster cleaning cycles.

BACKGROUND OF THE INVENTION

Known dry-cleaning processes consist of a wash, rinse, and draining/drying cycle with solvent recovery. During the dry-cleaning process, items, such as garments, are loaded into a basket disposed within a vessel and immersed in a dry-cleaning solvent that is pumped into the vessel from a base tank. Conventional dry-cleaning solvents include perchloroethylene (PCE), petroleum-based or Stoddard solvents, CFC-113, and 1,1,1-trichloroethane, all of which are generally aided by a detergent. Additionally, U.S. Pat. No. 5,467,492, entitled "Dry-Cleaning Garments Using Liquid Carbon Dioxide Under Agitation As Cleaning Medium" discloses an apparatus and method for employing a liquified gas, such as carbon dioxide, as the dry-cleaning solvent.

The dry-cleaning solvent functions to dissolve the soluble soils on the item. The insoluble soils, however, must be physically dislodged from the item. Accordingly, to remove the insoluble soils from the item, the item is typically agitated within the dry-cleaning solvent during the wash and rinse cycles of the dry-cleaning process.

Currently utilized methods for agitating items during dry-cleaning for the purpose of removing insoluble soils have disadvantages. For example, these methods do not provide a means whereby the degree of agitation may be easily controlled. As such, different dry-cleaning machines frequently must be manufactured, purchased, and/or used for items of differing fragility.

Furthermore, in dry-cleaning systems that utilize liquified gas, such as carbon dioxide, as the cleaning solvent, it is necessary that the liquified gas be completely removed from the cleaned items, vaporized to separate the contaminants and foreign particulate matter, and re-liquified for re-circulation through the system. The cycle time for such processing can be lengthy, thereby increasing the operating cost.

Accordingly, a need exists for an improved dry-cleaning system, and in particular, an improved liquified gas dry-cleaning system.

OBJECTS AND SUMMARY OF THE INVENTION

It is an object of the present invention to provide an improved dry-cleaning system which enables greater agitation of items being cleaned, and thus, enhanced and faster cleaning and quicker solvent removal upon completion of the cleaning cycle.

Another object of the invention is to provide a dry-cleaning system as characterized above that permits easy and selective control in the degree of agitation during the cleaning and solvent recovery cycles.

A further object is to provide an agitation system that is particularly adapted for enhancing cleaning and shortening cycling time in liquified gas dry-cleaning systems.

Other objects and advantages of the invention will become apparent upon reading the following detailed description and upon reference to the drawings, in which:

Figure 1:
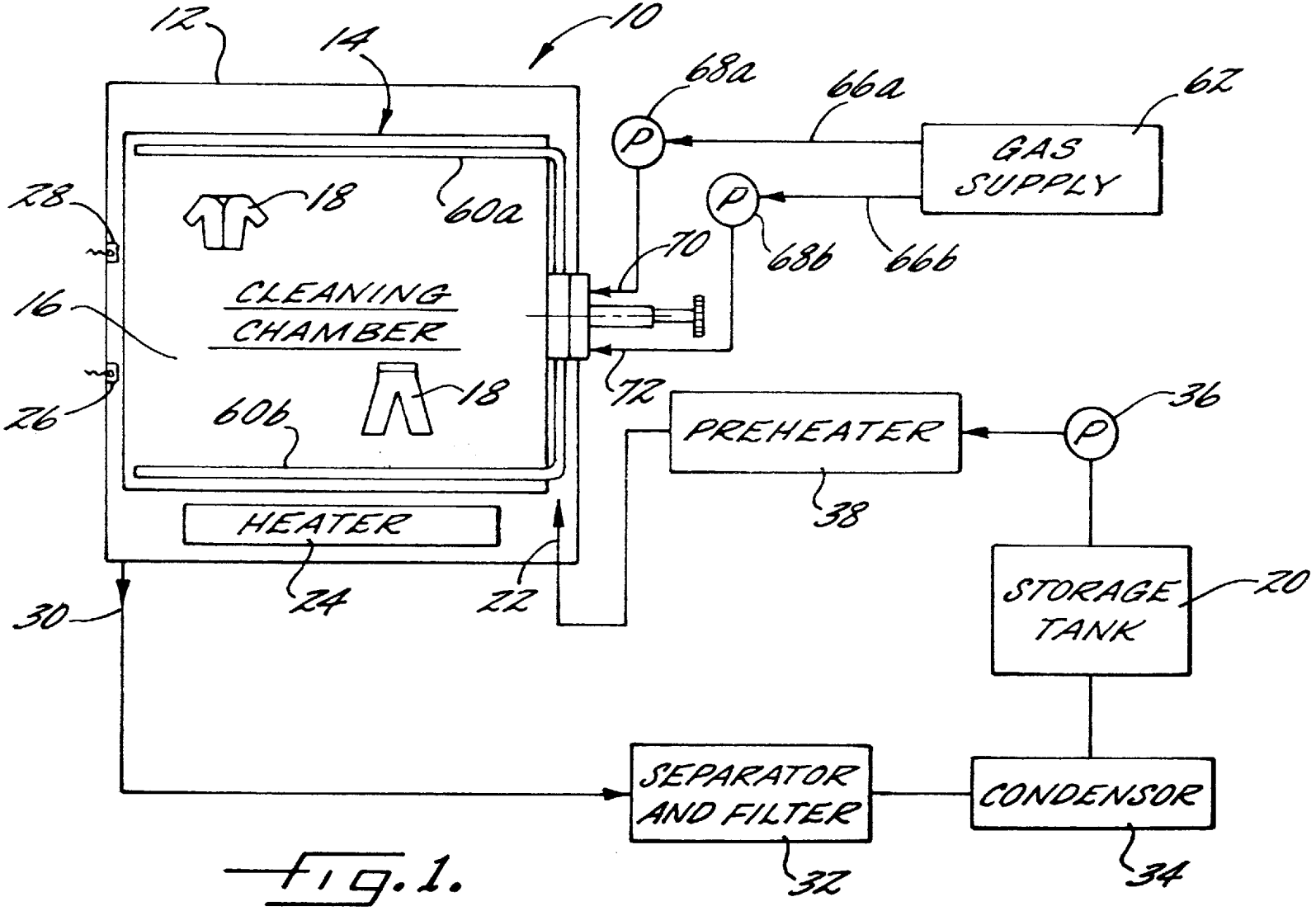
FIG. 1 is a schematic of a dry-cleaning system in accordance with the invention.

While the invention is susceptible of various modifications and alternative constructions, a certain illustrated embodiment thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE DRAWINGS

Referring now more particularly to FIG. 1, there is shown an illustrative dry-cleaning machine 10 embodying the present invention. The dry-cleaning machine 10 preferably utilizes a liquified gas as the dry-cleaning solvent, typical of U.S. Pat. Nos. 5,651,276, 5,467,492, and 5,651,276 the disclosures of which are incorporated herein by reference in their entirety. Nevertheless, it will be appreciated that the invention described hereinafter also may be used in connection with other types of dry-cleaning processes. Accordingly, the description that follows is not intended to be limiting.

In general, the dry-cleaning machine 10 includes a pressure vessel 12 having a rotatable perforated basket 14 disposed therein for containing items 18 to be cleaned. A liquid wash bath 16 derived from a liquifiable gas, such as carbon dioxide, is preferably used as the dry-cleaning solvent. A pump 36 is provided for directing the wash bath 16 from a storage tank 20 and through an inlet 22 into the pressure vessel 12. Between the pump 36 and the vessel 12, a pre-heater 38 is provided for use in maintaining the liquifiable gas in its liquid phase as it is moved from the storage tank 20 to the vessel 12. The vessel 12 is further equipped with a heater 24, pressure sensor 26, and temperature sensor 28 to aid in temperature and pressure control for properly maintaining the wash bath in liquid phase during the dry-cleaning cycle.

The basic operation of a liquid gas dry-cleaning system is known in the art, as reflected by the identified prior art. After the basket 14 is loaded with items, such as garments, for cleaning, the pump 36 charges the vessel 12 with a wash bath drawn from the storage tank 20. Such charging of the vessel 12 occurs both during wash and rinse cycles, and upon completion of those cycles, the wash bath 16 is drained from the vessel and remaining wash bath vapors evacuated and re-liquified by an appropriate condenser (not shown) for return to the storage tank.

For separating contaminants from the wash bath liquid following a cleaning cycle, the wash bath is cycled through a conventional filtration and separator system 32 which functions to filter and vaporize the wash bath, thereby concentrating the particulate matter and other contaminants. The gaseous vapor is re-liquified in a condenser 34 for return to the storage tank 20. Alternatively, the particulate matter may be removed from the wash bath by cooling the liquid to a point where the solvent capabilities of the liquified gas do not allow the particulates to remain suspended, as disclosed in the commonly assigned application Ser. No. 08/998,392, filed Dec. 24, 1997.

Figure 2:
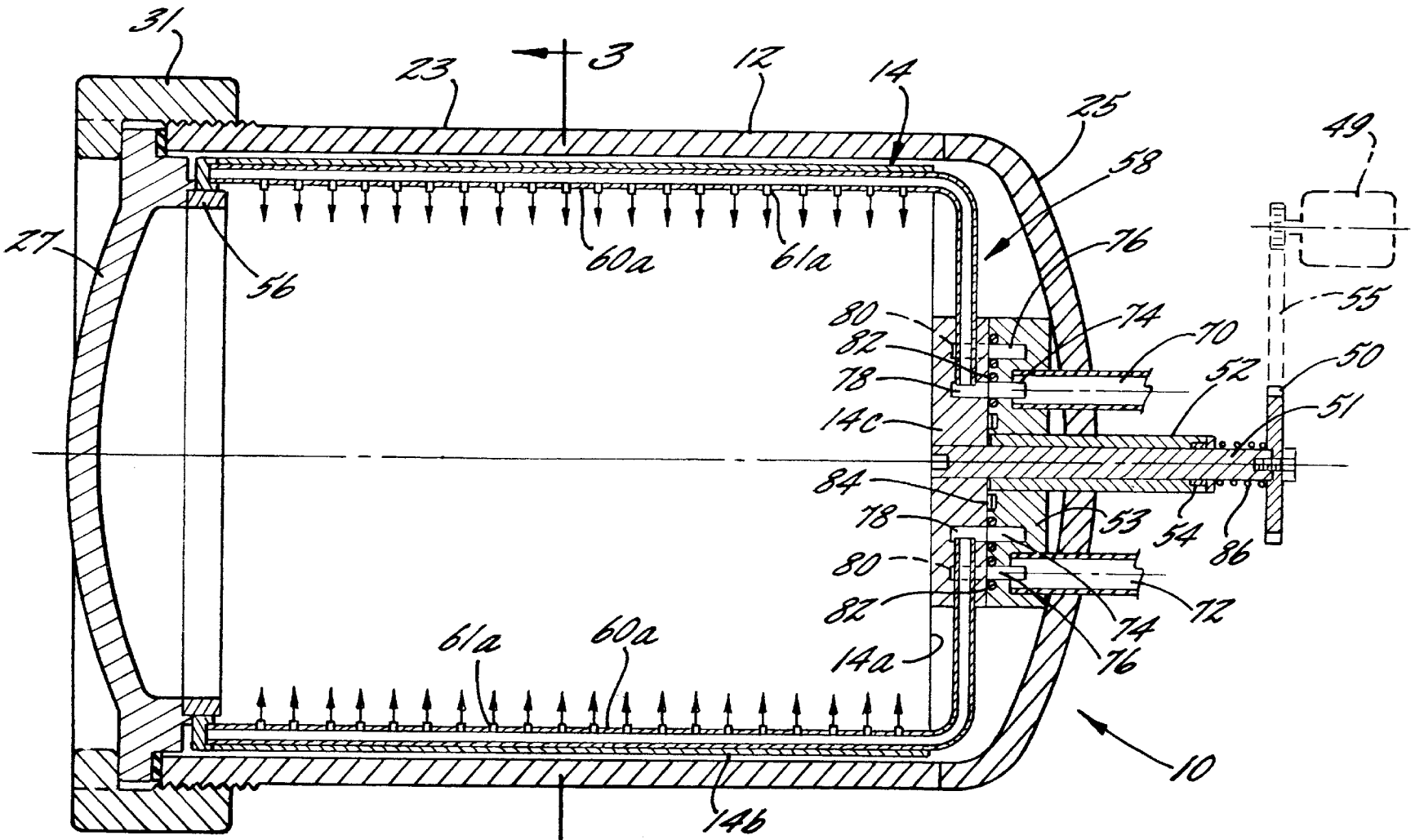
FIG. 2 is an enlarged longitudinal section of the dry-cleaning vessel of the system shown in FIG. 1.
Figure 3:
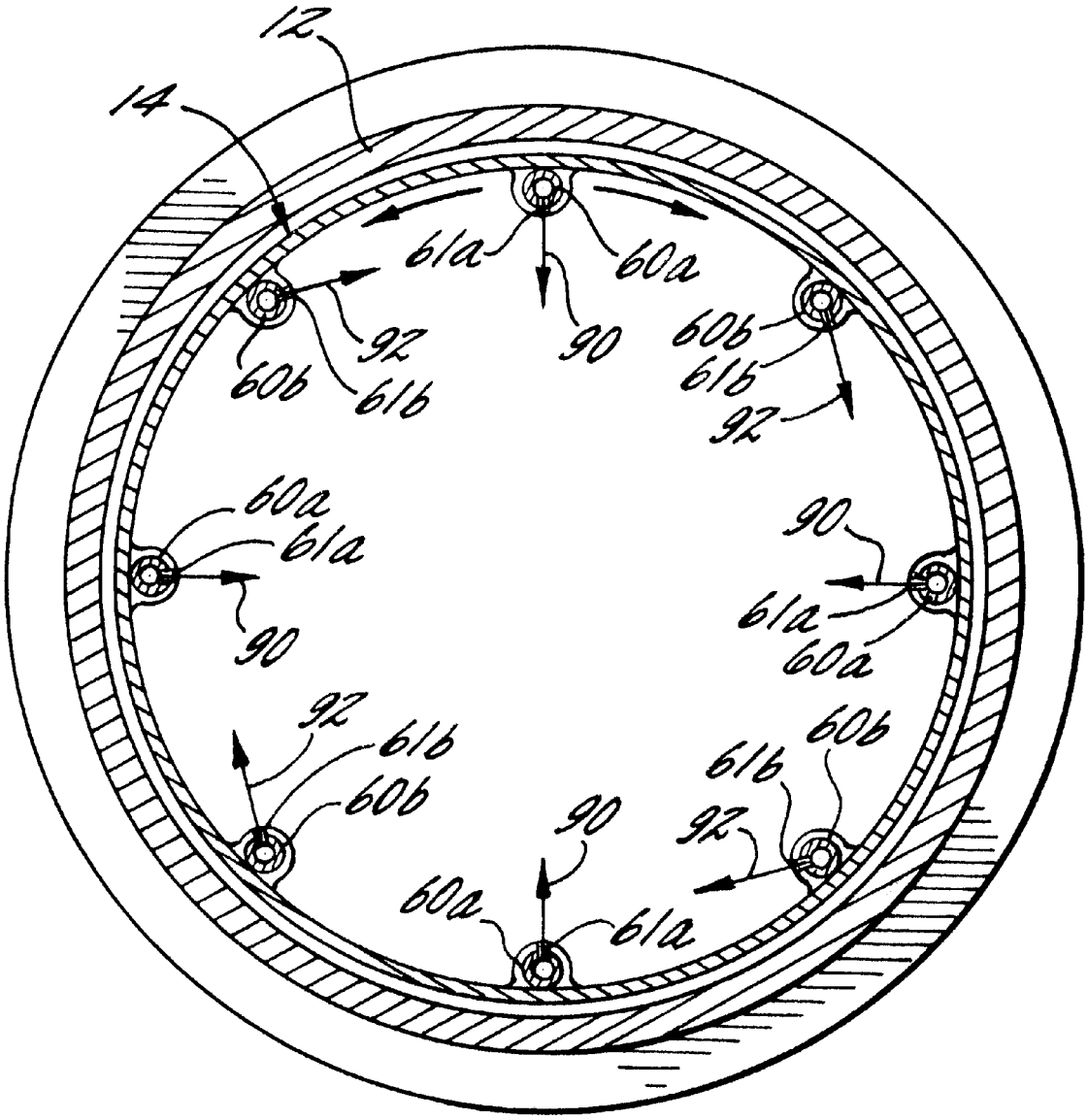
FIG. 3 is an enlarged vertical section of the dry-cleaning vessel taken in the plane of line 3—3 in FIG. 2.

The illustrated pressure vessel 12, as best depicted in FIGS. 2 and 3, comprises an elongated cylindrical housing 23 having a rounded end wall 25 permanently affixed at one end and a removable end wall 27, also of generally rounded configuration, releasably secured at the other end. The removable end wall 27 in this case has an outer annular retaining flange 29 secured in abutting relation to the end of the cylindrical housing 23 by means of a retaining cap 31 threadedly engaging the end of the cylindrical housing 23. The basket 14 is substantially coextensive in length with the cylindrical housing 23 and may have a perforated or other conventional grid-type structure that enables circulation of the liquid wash bath through the basket during wash and rinse cycles. For rotatably supporting the basket within the pressure vessel, the basket has a block-like end wall 14*c* with an outwardly extending support and drive shaft 51 supported in and extending through the end wall 25. The opposite end of the basket 14 is supported for relative rotational movement by an annular bearing 56 fixed adjacent the opposite end of the cylindrical housing 23.

In accordance with the invention, the dry-cleaning machine has means for enabling selective control in the degree and type of agitation to which the items contained in the basket and the wash bath are exposed during cleaning, rinse and draining cycles so as to enhance and speed up, the overall cleaning cycle. To this end, in the illustrative embodiment, the basket 14 has a variable speed, bi-directional motor 49 for enabling the basket 14 to be driven at selective speeds and rotary directions based upon the degree and type of agitation desired. The motor 49 in this case drives a drive sprocket 51 secured on the outwardly extended end of the basket support and drive shaft 51 via a chain 55. The basket drive and support shaft 51 is supported within an elongated bushing or housing 52, which in turn is supported in sealed relation by the pressure vessel end wall 25.

Hence, selected operation of the motor 49 enables control in rotary speed and direction of movement of the basket for desired agitation of the items and wash bath during the cleaning cycle and during removal of the liquid gas cleaning solvent from the cleaned items upon completion of the cleaning operation. In the latter case, enhanced agitation of the items following a cleaning operation not only is effective for enhancing removal of the liquid solvent from the cleaned items, and hence shortening the draining/drying cycle, the enhanced mechanical and frictional agitation of the items during such process tends to raise the temperature of the items and offset a temperature drop that may occur by reason of evacuation of wash bath vapors from the pressure tank during and at the end of the wash cycle, prior to removal of the items from the washer.

In accordance with a further aspect of the invention, a gas jet agitating system 58 is provided which is operable, alone or in combination with selective rotary driving movement of the basket, to enable enhanced, selectively controlled, agitation of the items and wash bath throughout the cleaning operation. The illustrated gas jet agitation system 58 includes a plurality of gas jet delivery manifolds 60*a*, 60*b* fixed to the basket 14, and extending along the length thereof in parallel relation to the axis of rotation of the basket. The delivery manifolds 60*a*, 60*b* each include a plurality of longitudinally spaced nozzles 52 for directing a plurality of pressurized gas streams or jets simultaneously with rotational movement of the basket 14. It will be understood that the nozzles may be discrete spray nozzles supported by the delivery manifolds, or alternatively, may be in the form of apertures formed in the conduits that define the delivery manifold 60*a*, 60*b*. While the gas jet delivery manifold 60*a*, 60*b* have been shown as individual conduits fixed to the basket 14, alternatively, the manifolds could be an integral part of the basket 14.

For supplying pressurized gas to the manifolds 60, each manifold in this instance has a hollow tubular form with a radially in turned end 61 fixed to and communicating with the end wall 14*c* of the basket. The end wall 14 is formed with inner and outer circular ports 78, 80, each communicating with respective ones of the delivery manifolds 60*a*, 60*b*. The circular ports 78, 80 in turn communicate with circular ports 74, 76, respectively, in a stationary manifold block supported 53 on the shaft housing or bushing 52 immediately adjacent an inner side of the pressure vessel end wall 25. The manifold block ports 74, 76 each communicate with a respective inner and outer supply line or manifold 70, 72, which in turn are connected to a gas supply reservoir 62 via respective piping 66*a*, 66*b* and pressure pumps 68*a*, 68*b*, as shown in FIG. 1. The supply reservoir gas preferably is the same liquifiable gas used for the cleaning solvent, preferably carbon dioxide. Other non-flammable, non-toxic gases could alternatively be used.

By virtue of the flow communication between the circular ports 74, 76 of the manifold block and the ports 78, 80 of the basket end wall 14*c*, it can be seen that gas may be selectively directed to the respective manifolds 60*a*, 60*b* via the supply lines 66*a*, 66*b*. The delivery manifolds 60*a*, 60*b* in this instance are arranged such that alternative delivery manifolds 60*a* circumferentially disposed about the perimeter of the basket 14 are in flow communication with the inner manifold 70 and alternatively disposed delivery manifold 60*b* are in flow communication with the outer manifold 72.

For maintaining sealed engagement between the manifold block 53 and the end wall or block 14*c* of the basket 14, seals 82 are positioned in interposed relation between the end wall 14*c* and manifold block 53 to prevent the entry of wash bath into the gas manifold block 53. It will be seen that since pressure within the vessel 12 acts upon the entire inner side of the basket end wall 14*c*, while the support and drive shaft 15 for the basket is at atmospheric pressure, the resulting differential pressure tends to force the basket end wall 14*c* into engagement with the seals 82 and manifold block 53 for enhanced sealing. A thrust bearing 54 and thrust spring 83 accommodate and resist such axial force.

During a wash cycle, selected direction of gas through the piping 66*a*, 66*b* upon operation of the pumps 68*a*, 68*b* will direct a multiplicity of gas jet streams from the respective manifolds 60*a*, 60*b* into the wash liquid and against items contained within the basket to agitate both the wash bath and the contained items for enhanced cleaning and solvent particulate removal. Moreover, the degree of agitation may be controlled by selected operation of either the pump 68*a*, 68*b*, thereby enabling gas jet agitation to be directed through some or all of the delivery manifolds 60*a*, 60*b*.

In keeping with the invention, to enable further control in the degree and type of agitation of the items being cleaned and the wash bath during a cleaning cycle, the nozzles 61*a* of the delivery manifold 60*a* are arranged to direct gas jet flows in one direction with respect to the basket 14 and the nozzles 61*b* of delivery manifold 60*b* are oriented to direct the gas jet flows in a second direction relative to the basket different from the nozzles of the delivery manifold 60*a*. In the illustrated embodiment, the delivery manifolds 60*a* have their nozzles 6152*a* arranged to direct the gas jet flows in a general radial direction 90 relative to the basket, while the delivery manifolds 60*b* have their associated nozzles 61*b* arranged to direct the gas flow in a generally tangential direction 92 relative to the basket 14.

Hence, during a dry cleaning cycle with a load of items, such as garments, in the basket 14, the tangentially directed gas jets from the delivery manifolds 60*b* will enhance agitation and cleaning of the exterior of the garments in the basket. The radial gas jets from the delivery manifolds 60*a,* on the other hand, will act to move the garments to and from the cleaning influence of the tangential gas jet flows. Operating the motor 49 to rotate the basket 14 and the gas jet manifolds 60*a,* 60*b* in the direction of the tangential wash bath, as generated by the manifold nozzles 60*b,* will augment the movement of the internal wash bath to effectively increase the wash bath contact with the garments. As a result, the garments can be subjected to a greater degree of agitation with enhanced washing effectiveness. On the other hand, operating the motor 49 to rotate the basket 14 and the gas jet agitating system 58 in a direction opposite to the tangential wash bath flow generated by the nozzles 52*b* effectively decreases wash bath flow contact with the garments. This subjects the garments to a lesser degree of agitation. In this manner, the dry-cleaning machine of the present invention enables selective control in the degree of agitation during the wash and rinse cycles, depending upon the fragility of the items being cleaned and the particular cycle in the cleaning operation.

Figure 4:
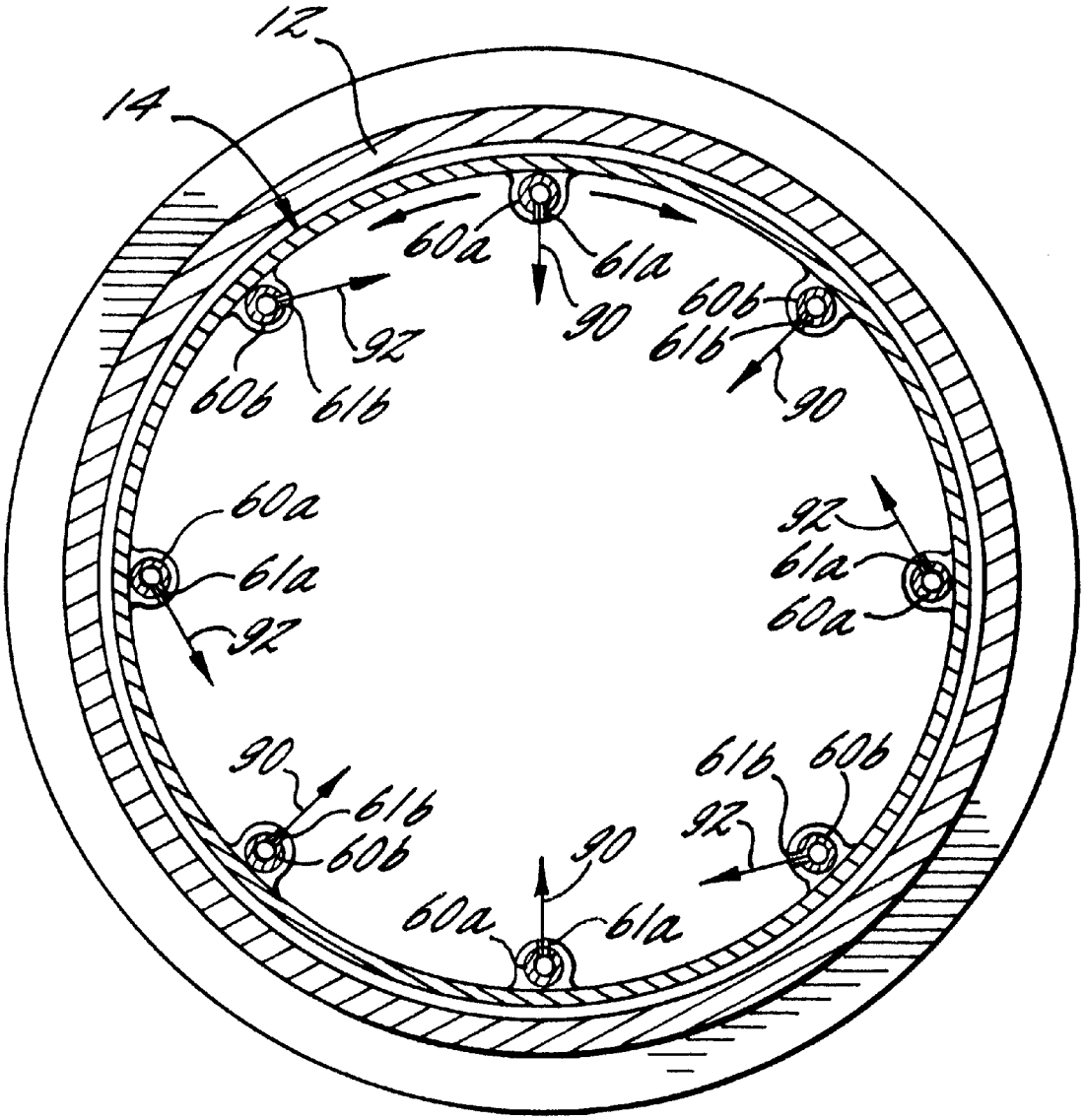
FIG. 4 is an alternative, enlarged vertical section of the dry cleaning vessel taken in the plane of line 3—3 in FIG. 2.

In an alternative embodiment of the invention, illustrated in FIG. 4, the degree and type of agitation is enabled by selectively using one of the delivery manifolds 60*a* or 60*b* during the cleaning cycle. In this embodiment, the nozzles 61*a* of delivery manifolds 60*a* and the nozzles 61*b* of manifolds 60*b* are both arranged to direct gas jet flows sequentially in a generally radial direction 90 relative to the basket and a generally tangential direction 92 relative to the basket. The tangential gas jet flows generated by nozzles 61*a* are, however, generally in an opposite direction to the tangential gas jet flows generated by nozzles 61*b.* In this manner, one of the gas-jet flow delivery circuits 60*a* or 60*b* is rendered operable to selectively augment or reduce the wash bath cycle in the manner described previously as a function of the direction of rotation of the basket. Accordingly, this alternative embodiment is seen to be particularly useful when a uni-directional motor is provided to drive the basket.

From the foregoing, it can be seen that the subject invention has, among others, the advantage of providing an improved means for controlling the degree of agitation experienced by items being cleaned. Preferably, the operator may select a desired cleaning intensity, e.g., gentle cycle, aggressive cycle, etc., from an operator console. The operator console, utilizing a processor in a known manner, would then function to automatically control the rotational direction and speed of the motor and the selective activation of the gas-jet agitation system during the dry-cleaning process for the desired result.

I claim:

1. A liquified gas dry-cleaning system comprising:

a pressure vessel for containing a wash bath of a liquified gas under pressure;

a basket rotatably supported within the pressure vessel for containing items during cleaning;

a drive for rotating the basket within the pressure vessel to agitate items during a cleaning cycle;

a liquified gas jet agitation system having a plurality of nozzles mounted on said basket; and a liquified gas supply operable for selectively directing liquified gas to said nozzles as said basket is rotated, which in turn direct pressurized jet streams of liquified gas into the basket for causing movement of the liquid wash bath and for further agitation of items contained therein simultaneously with agitation incident to rotation of the basket.

2. The dry-cleaning system as recited in claim 1, wherein said drive comprises a variable speed bi-directional motor for selectively rotating the basket in opposite directions.

3. The dry-cleaning system as recited in claim 1, wherein the gas-jet agitation system comprises a plurality of gas delivering manifolds extending along the length of the basket each having a plurality of said nozzles.

4. The dry-cleaning system as recited in claim 3, wherein the delivery manifolds are secured to the basket.

5. The dry-cleaning system as recited in claim 1, wherein the plurality of nozzles are arranged in a plurality of nozzle sub-sets linearly along the interior of the basket.

6. The dry-cleaning system as recited in claim 5, wherein the plurality of nozzle sub-sets are disposed in parallel relation to an axis of rotation of said basket.

7. The dry-cleaning system as recited in claim 6, wherein the plurality of nozzle sub-sets are arranged to produce an alternating pattern of generally tangentially directed and generally radially directed wash bath flows relative to the basket.

8. The dry-cleaning system as recited in claim 1, in which the gas-jet agitation system includes a manifold block having an intake manifold coupled to a source of gas and a first port in flow communication with the intake manifold, and said basket including an end wall having a second port in flow communication with the plurality of nozzles, and said first port and second port cooperating to maintain the plurality of nozzles in flow communication with the source of gas when the basket rotates.

9. The dry-cleaning system as recited in claim 8, wherein the wash bath is contained within the vessel under pressure, said basket including a drive shaft extending outwardly of said vessel through said manifold block such that pressure within said vessel maintains engagement between said basket end wall and said manifold block.

10. A liquified gas dry-cleaning system; comprising:

a vessel for containing a fluid wash bath derived from the liquifiable gas;

a basket disposed within the vessel for holding an item to be dry-cleaned; and a gas-jet agitation system disposed within the vessel having a first plurality of nozzles and a second plurality of nozzles;

said first plurality of nozzles being oriented about the perimeter of the basket for directing gas jets in one direction against the liquid wash bath to move the wash bath and agitate items contained in the basket for enhanced cleaning; and said second plurality of nozzles being oriented for directing gas jets against said liquid wash bath in a second direction different from said first direction for further moving the wash bath and agitating the items in the basket.

11. The liquified gas dry-cleaning system as recited in claim 10 in which said first plurality of nozzles are oriented for directing gas jets in a tangential direction relative to the basket, and the second plurality of nozzles are oriented for directing gas jets in general radial direction relative to the basket.

12. The liquid carbon dioxide cleaning system as recited in claim 11, wherein the first and second plurality of nozzles are arranged to produce an alternating pattern of generally tangentially directed and generally radially directed wash bath flows relative to the basket.

13. The liquid carbon dioxide cleaning system as recited in claim 12, wherein the first and second plurality of nozzles are movable relative to the vessel.

14. The liquid carbon dioxide cleaning system as recited in claim 13 wherein the first and second plurality of nozzles are mounted on the basket.

15. A dry-cleaning system, comprising:

a vessel for containing a liquid wash bath of a dry-cleaning solvent;

a basket rotatably disposed within the vessel for holding soiled items during cleaning;

a motor operable to rotate the basket within the vessel to agitate items therein during a cleaning cycle; and a gas jet agitation system having a plurality of nozzles rotatable with the basket for directing pressurized gas jet streams effective for causing movement the liquid wash bath and further agitation of the items simultaneously with agitation incident to rotation of the basket, said plurality of nozzles including a first subset of nozzles arranged to produce a wash bath flow in one direction relative to the basket and a second subset of nozzles arranged to produce a wash bath flow in a second direction relative to the basket different from said first direction.

16. The dry-cleaning system as recited in claim 15, wherein said first sub-set of the plurality of nozzles are arranged to produce a wash bath flow in a generally tangential direction relative to the basket and said second sub-set of the plurality of nozzles are arranged to produce a wash bath flow in a generally radial direction relative to the basket.

* * * * *